US007104193B2

(12) United States Patent
Adamczyk

(10) Patent No.: US 7,104,193 B2
(45) Date of Patent: Sep. 12, 2006

(54) GRAVURE PRINTING PLATE AND VALUABLE DOCUMENT PRODUCED BY THE SAME

(75) Inventor: Roger Adamczyk, München (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 10/362,524

(22) PCT Filed: Sep. 5, 2001

(86) PCT No.: PCT/EP01/10227

§ 371 (c)(1),
(2), (4) Date: Sep. 9, 2003

(87) PCT Pub. No.: WO02/20279

PCT Pub. Date: Mar. 14, 2002

(65) Prior Publication Data

US 2004/0025728 A1 Feb. 12, 2004

(30) Foreign Application Priority Data

Sep. 8, 2000 (DE) ..... 100 44 711

(51) Int. Cl.
*B41N 1/06* (2006.01)

(52) U.S. Cl. ..... 101/150; 101/170; 101/401.1; 358/3.31

(58) Field of Classification Search ..... 101/150, 101/153, 170, 395, 401, 401.1; 358/3.29, 358/3.3, 3.31, 3.32
See application file for complete search history.

(56) References Cited

U.S. PATENT DOCUMENTS

| | | | | |
|---|---|---|---|---|
| 4,033,059 A | | 7/1977 | Hutton et al. | |
| 4,588,212 A | | 5/1986 | Castagnoli | |
| 4,597,593 A | * | 7/1986 | Maurer | 283/94 |
| 5,019,488 A | | 5/1991 | Mammato et al. | |
| 6,162,867 A | | 12/2000 | Guntherberg et al. | |
| 6,840,721 B1 | * | 1/2005 | Kaule et al. | 409/132 |
| 6,928,925 B1 | * | 8/2005 | Mayer et al. | 101/150 |
| 2001/0043842 A1 | | 11/2001 | Kaule et al. | |
| 2003/0145747 A1 | | 8/2003 | Mayer et al. | |

FOREIGN PATENT DOCUMENTS

| | | | |
|---|---|---|---|
| DE | 2111628 | | 9/1972 |
| DE | WO00/20216 | * | 4/2000 |
| DE | 19845436 | * | 4/2000 |
| DE | 19845440 | * | 4/2000 |
| EP | 0146151 A1 | | 5/1986 |
| EP | 0477442 A1 | | 4/1992 |
| GB | 1390302 | | 4/1975 |
| JP | 2001-71451 | * | 3/2001 |
| WO | WO 8912256 A1 | | 12/1989 |
| WO | 97/48555 | * | 12/1997 |
| WO | 00/20217 | * | 4/2000 |
| WO | WO 9748555 A1 | | 11/2001 |
| WO | WO 0149505 A1 | | 8/2003 |

* cited by examiner

*Primary Examiner*—Ren Yan
*Assistant Examiner*—Joshua Zimmerman
(74) *Attorney, Agent, or Firm*—Bacon & Thomas

(57) ABSTRACT

The invention relates to an intaglio printing plate for producing a printing image with at least one engraved area in the printing plate surface, characterized in that the engraved area has one or more structural elements in which the edge area has a greater engraving depth than the inside area, the edge area and the inside area are directly adjacent, and the inside area is designed as a plateau that is lowered relative to the printing plate surface, to a method for producing the printing plates, to a data carrier with a printed image produced by intaglio, and an intaglio printing process.

23 Claims, 3 Drawing Sheets

GRAVURE PRINTING PLATE AND VALUABLE DOCUMENT PRODUCED BY THE SAME

BACKGROUND OF THE INVENTION

1. Field of the Invention

This invention relates to a data carrier with a printed image produced by intaglio, to an intaglio printing process as well as to printing plates for carrying out the intaglio printing process and a method for producing the printing plates.

2. Related Art

It is distinctive for gravure printing that the printing, i.e. ink-transferring, areas of the printing plate are present as depressions in the plate surface. These depressions are produced by a suitable engraving tool or by etching. Before the actual printing operation, ink is applied to the engraved plate and surplus ink removed from the surface of the plate by a stripping doctor blade or wiping cylinder so that ink is left behind only in the depressions. Then a substrate, normally paper, is pressed against the plate and removed, the ink adhering to the substrate surface and forming a printed image there. If transparent inks are used, the thickness of inking determines the color tone. The high bearing pressure subjects the substrate material additionally to embossing, which also stands out on the back of the substrate.

Among gravure printing techniques a distinction is made between rotogravure and intaglio or line intaglio. In rotogravure, the printing plates are produced for example by electron beam, laser beam or graver. It is distinctive for rotogravure that different gray or color values of the printed image are produced by cells of different density, size and/or depth disposed regularly in the printing plate.

In contrast, in intaglio linear depressions are formed in the printing plates to produce a printed image. In the mechanically fabricated plate for intaglio, a wider line is produced with increasing engraving depth due to the usually tapered engraving tools. Furthermore, the ink receptivity of the engraved line and thus the opacity of the printed line increases with increasing engraving depth. In the etching of intaglio plates, the nonprinting areas of the plate are covered with a chemically inert lacquer. Subsequent etching produces the engraving in the exposed plate surface, the depth of the engraved lines depending in particular on etching time and line width.

The intaglio technique, in particular the steel intaglio technique, provides a characteristic printed image that is easily recognizable to laymen and not reproducible with other common printing processes. If the engravings in the printing plate are deep enough, a data carrier printed by intaglio is given through embossing and inking a printed image that forms a relief perceptible with the sense of touch. Steel intaglio is therefore preferably used for printing data carriers, in particular security documents and documents of value, for example bank notes, shares, bonds, certificates, vouchers, security labels and the like, which must meet high standards with respect to forgery-proofness.

WO 97/48555 discloses a method for producing intaglio printing plates in reproducible fashion by machine. The lines of a line original are detected and the surface of each line precisely determined. An engraving tool, for example a rotating graver or laser beam, is first used to engrave the outside contour of this surface to cleanly border the surface. The bordered area of the surface is then cleared by means of the same or another engraving tool so that the total line is precisely engraved in accordance with the line original. Depending on the form and guidance of the engraving tool, a basic roughness pattern serving as an ink trap for the printing ink arises at the base of the cleared surface.

To obtain a sufficient measure of tactility of the image produced by intaglio, very thick inking is required according to prior art methods. Thick inking, however, at the same time means high consumption of ink, which in turn results in high production costs. In addition, the quantity of ink applied to the plate must be increased in the conventional technology to close with ink all engraved areas that are to yield tactile structures in the printed image. Thus, there is more surplus ink that must be removed from the surface of the plate by a stripping doctor blade or wiping cylinder, which leads to problems in the waste disposal of the wiped inks.

BRIEF SUMMARY OF THE INVENTION

The problem of the present invention is to retain or improve the tactility of the printed image while simultaneously saving ink, without changing the color effect of the printed image compared to an image printed by the conventional intaglio technique.

The inventive intaglio printing plate is characterized by at least one engraved area in the plate surface, the engraved area having one or more structural elements in which the edge area has a greater engraving depth than the inside area, the edge area and inside area are directly adjacent and the inside area is designed as a plateau that is lowered relative to the plate surface. A printed image engraved into the inventive intaglio plate preferably has a plurality of such structural elements.

The engraving depth difference between edge areas and inside areas increases the tactility in the inventively produced printed image since the relief structure of the printed area is much more complex compared to a printed image produced according to the prior art. The printed area has a grooved profile in cross section that is tactilely perceptible when the bare finger runs over it. The frequent change from tactile edge area to inside area further strengthens the characteristic tactile impression of an intaglio image. If the engraved areas have corresponding dimensions, the transition of elevations and depressions in the printed image is distinctly tangible so that the different edge and inside areas can be individually perceived.

In addition, ink is saved despite equal or even improved tactility of the printed image, since enough ink to ensure tactility need only be transferred in the edge area. In the inside area, only enough ink to attain the desired color tone need be transferred. The inside areas must therefore be engraved less deep in the plate than the edge areas, thereby distinctly reducing the ink-receiving volume of the engraved area. In addition, printing problems can be avoided that arise through the filling of large surfaces that are engraved especially deep, such as ink splashing out of the engraved area during the printing operation or incomplete transfer of ink from the engraving to the surface of the substrate to be printed.

The cross-sectional profile of the edge area in the plate can have any possible form, but is expediently wedge-shaped or trapezoidal. A step-shaped design of the edge area is also possible, i.e. the edge area itself has different engraving depths. If there are a plurality of structural elements of a printed image, the edge areas can also have the same or different form independently of each other. For example, the edge area of one structural element can be engraved in a wedge shape and another as a trapezoid.

The geometry of the wedge and trapezoid form is not subject to any restrictions, i.e. aspect ratios and angles can be selected by the expert without restriction.

The inside area is lowered relative to the plate surface, the cross-sectional profile being formed as a plateau, i.e. the inside area forming a plane preferably aligned parallel to the plate surface. Designs are of course also possible by which the inside area is an inclined plane relative to the plate surface.

The surface of the inside area can be equipped with a basic roughness pattern that serves as an ink trap for the printing ink. This is expedient when the inside area has dimensions as of a length and width of about 100 microns. The basic roughness pattern can also be incorporated in case of trapezoidal or rectangular edge areas having a base surface at least about 100 microns wide and long. The basic roughness pattern is produced at the base of the cleared surfaces during engraving of the plate for example according to the method described in WO 97/48555.

Edge area and inside area directly abut, i.e. they are directly adjacent and not spaced by bars at the plate level. In the later printed image, edge and inside areas are thus not separated by unprinted areas.

The engraving depth and width of the edge and inside areas of a structural element are selected by the expert so as to produce the desired width, ink layer thickness and color tone of the corresponding printed structural elements in the later printed image.

If commercial intaglio inks are used, the engraving depth of the edge area is about in the range of 60 microns to 150 microns, and that of the inside area about in the range of 10 microns to 120 microns.

Preferably, the engraving depth of the edge area is in the range of 100 microns to 150 microns, and that of the inside area in the range of 60 microns to 100 microns. At these engraving depths, an ink layer thickness at which the inks are already opaque and no longer have a transparent effect is attained in the printed image with commercial intaglio inks, i.e. a printed image produced with an accordingly deep engraved printing plate has only one color tone. A printed image can thus be produced that has a uniform color tone over its total surface and an edge that is not color contrasting but nevertheless tactilely perceptible.

At engraving depths of less than about 60 microns, the inks have a transparent character in the printed image. They are no longer opaque at these engraving depths, i.e. the color tone in the printed image depends on the ink layer thickness. If these engraving depths are selected, the printed images can be equipped with an edge that is tactilely perceptible and contrasts in color with the inside area. Moreover, there is the possibility of combining an opaque edge area with a transparent inside area.

If the inside area is not designed as a plateau parallel to the plate surface but as an inclined plane, color progressions from light to dark can also be produced in the inside area of the structural element using transparent inks.

Further, the engraving depth of an edge area can be increased or reduced continuously or in steps, for example in the course of an engraved line. If a plurality of inventive structural elements are provided in the printed image, the edge and inside areas can have the same or different engraving depth independently of each other.

Mere variation of the engraving depth in the edge and inside areas can thus produce a great variety of possibilities of combination and design in the printed image.

The engraving width of the edge and inside areas is determined mainly by the desired printed image. The engraving width of the edge area is in the range of 120 microns to 500 microns. The engraving width of the inside area necessarily results in the engraving of the structural element from the engraving width of the structural element, the engraving width of the edge area and the engraving depth of the inside area.

The structural element can represent any geometrical element, e.g. lines of a great variety of widths, preferably with a width up to 3 millimeters or more, or elements with an e.g. circular, triangular, square or asymmetric outline structure, a pictorial symbol, character or other symbol, whereby characters, in particular alphanumeric characters, are preferred. A plurality of structural elements can also be combined in any number and form. It is of course also possible to combine the inventively printed lines and/or elements with lines and/or elements produced with other printing process, e.g. conventional intaglio, offset, etc.

The inventive intaglio printing plates are preferably produced by engraving with a fast rotating, tapered graver. In accordance with the outline form of the surface to be printed, depressions are formed by the engraving tool in the surface of the plate with selective variation of the engraving depth and filled with ink for the printing operation. During printing, ink is transferred from the depressions of the plate to the surface of a substrate. No ink is transferred from the untreated, i.e. unengraved, surface areas of the plate.

When a data carrier is printed by the method just described, an accordingly designed printed image results on the data carrier in dependence on the form of the above-described engraving of the inventive plate. This data carrier is characterized according to the invention by at least one structural element produced by intaglio and having different ink layer thicknesses at the edge area and inside area. The edge area and inside area are directly adjacent, the edge area having greater ink layer thickness than the inside area and the inside area being designed as a plateau that is lowered relative to the edge area. The dimensions of the ink layer areas in the printed image, such as width and ink layer thickness, result from the abovementioned values for engraving depth and width of the inventive plate and in dependence on the ink used in printing. However, the transitions between edge and inside areas and the edges and corners of the printed areas are not absolutely precisely delimitable as in the engraved plate. The transitions between edge and inside areas and the form of the edges and corners in the printed image are more or less fluid in dependence on the ink composition used and its viscosity and in dependence on the plate engraving depth.

As described above, the ink thickness difference between edge areas and inside areas leads to elevated tactility of the inventively produced structural element of the printed image, since the relief structure of the printed area is much more complex compared to a printed image produced according to the prior art. The cross-sectionally grooved profile of the printed areas is better perceptible tactilely when the bare finger runs over it. If the engraved areas have corresponding dimensions, the transition of elevations and depressions in the printed image is distinctly tangible so that the different edge and inside areas can be individually perceived.

In addition, ink is saved despite the same or even improved tactility of the printed image, since the inside areas have less ink than the edge areas.

Depending on the selected ink layer thickness of the edge and inside areas, usual intaglio inks can be printed opaquely or, to a certain degree, transparently and translucently. With suitable layer thicknesses and an expedient choice of background color, color tones with different brightness and color saturation are obtained. If ink layer thicknesses are sufficiently different, contrasts are obtained that are readily visible to the human eye without further aids. This presupposes normal lighting conditions and a normal viewing distance.

If opaque inks are used in the inventive print, a printed image is produced that has a uniform color tone over its total surface independently of how thick the inking is, and has an edge that is not color contrasting but nevertheless tactilely perceptible.

If transparent inks are used in the inventive print, the color tone in the printed image depends on the ink layer thickness. Thus, printed images can be equipped with a tactilely perceptible edge in color contrast with the inside area, or an opaque edge area combined with a transparent inside area, in dependence on the ink layer thickness.

The remarks on the engraving of the printing plate apply accordingly to the ink layer of the inside and edge areas with respect to the possibilities of design variation.

All substrate materials that can be used for intaglio are suitable for printing with the inventive method, such as paper, plastic foils, paper laminated with plastic foils, varnished paper and multilayer composite materials. In particular, the inventive method is suitable for printing data carriers that must meet high standards with respect to forgery-proofness, such as security documents and documents of value, for example bank notes, shares, bonds, certificates, vouchers, security labels and the like.

DESCRIPTION OF THE DRAWINGS

Further embodiments and advantages of the invention will be explained in the following with reference to the Figures. The proportions shown in the Figures do not necessarily correspond to the actual relations and serve primarily to improve clarity.

DETAILED DESCRIPTION OF THE PREFERRED EMBODIMENTS OF THE INVENTION

Figure 1:
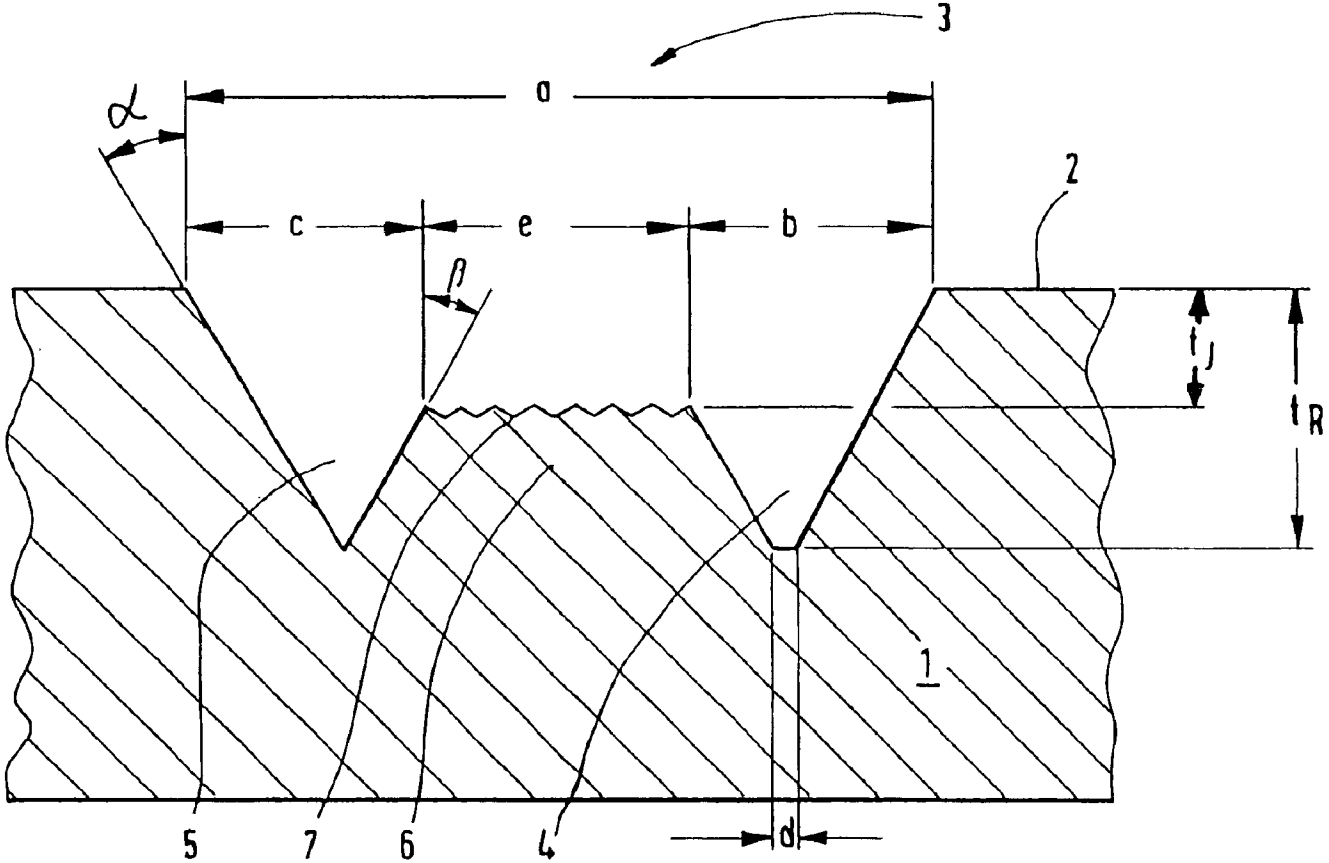
FIG. 1 shows a detail of an inventive printing plate in cross section.

FIG. 1 shows a detail of printing plate 1 in cross section whose surface 2 is provided with engraving 3 with width a that serves to receive ink. Engraving width a can be up to about 3 millimeters and more. The engraving is composed of two edge areas 4 and 5 and inside area 6, the edge areas being directly adjacent to the inside area. The inside area was additionally equipped with a basic roughness pattern as ink trap 7. Edge area 5 is wedge-shaped and edge area 4 trapezoidal. In the wedge-shaped variant, the width of base surface d is equal to 0 microns or, due to a certain spatial extent of the engraving graver, approximately 0 microns and can reach 10 microns. In the trapezoidal or other rectangular design, d is in the range of 10 microns to 500 microns. If a cone with a rounded tip is used as a graver in engraving, it is to be taken into account that corners and edges are engraved in rounded fashion. The resulting geometrical form of the edge area is thus for example a wedge with a round tip. Instead of two edge areas, however, it is also possible to engrave only one edge area deeper. This embodiment can be used especially expediently for example on one side of a self-contained line in free form or as a border of a closed geometrical figure such as a circle. Likewise, the border can be engraved deeper only in a partial area. Thus, it is possible e.g. in the case of a rectangle to design only one side line as a deeper engraved edge area. The edge area is still characterized by its engraving depth, engraving width and flank angles $\alpha$ and $\beta$, whereby if there are a plurality of edge areas these can have the same or different engraving depths, widths and flank angles independently of each other. In the present case, edge area 4 has engraving depth $t_R$, engraving width b and flank angles $\alpha$ and $\beta$. Edge area 5 likewise has engraving depth $t_R$ and flank angles $\alpha$ and $\beta$ but engraving width c. Flank angles $\alpha$ and $\beta$, based on the plumb line to the plate surface, preferably range from 30 to 60° and can be selected independently of each other. Expediently, the edge areas have the same form, i.e. trapezoidal or wedge form, with the same engraving depth, width and flank angles. The inside area has engraving depth $t_i$, that is smaller than engraving depth $t_R$ of the edge area. Engraving width e of the inside area results in dependence on engraving width a, the geometrical dimensions of the edge areas and engraving depth $t_i$.

Figure 2:
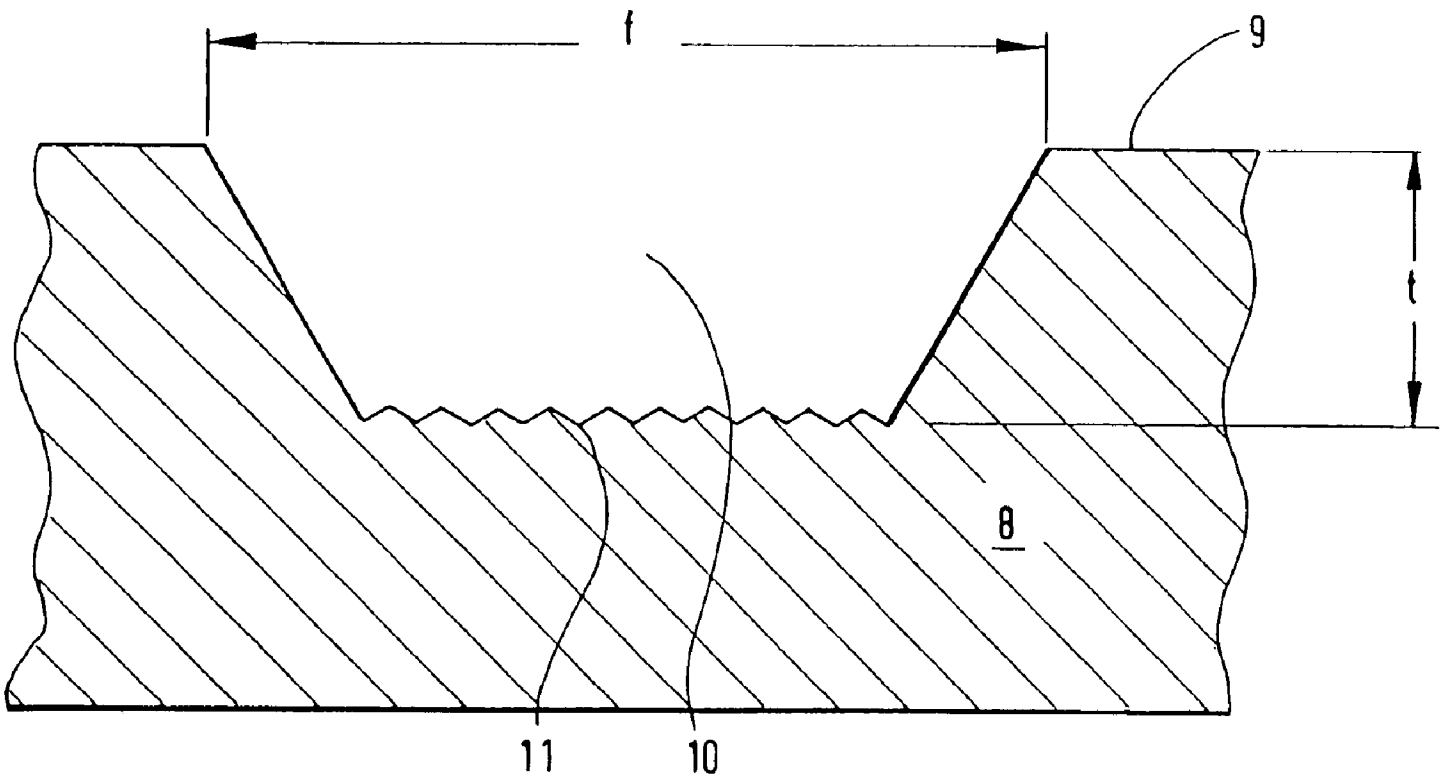
FIG. 2 PRIOR ART
FIG. 2 shows a detail of a conventional printing plate in cross section.

FIG. 2 shows the cross section of printing plate 8 with engraved surface 9 according to the prior art. Engraving 10, which serves to receive ink and is equipped with ink trap 11, does not show an inventive division into areas of greater and smaller engraving depth. Engraving depth t is constant over the total engraved area. Tactility is determined by engraving depth t and engraving width f of the total surface, which does not have an inventively worked relief. Due to the uniform engraving depth, the volume of the ink-receiving area is greater in comparison with the inventive plate by the volume of the cleared inside area so that much more ink is required to produce the same tactility and, if opaque inks are used, the same color effect as with the inventive plate.

Figure 3:
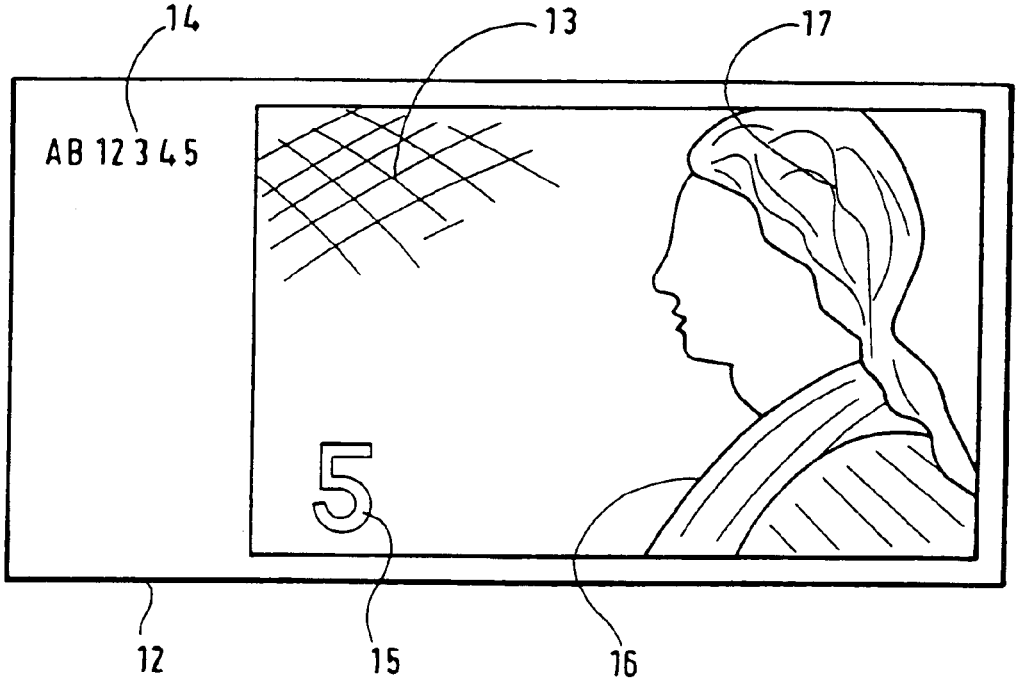
FIG. 3 shows a bank note in a front view.

FIG. 3 shows a sketch of a bank note as data carrier 12. A bank note usually has different types of prints. The shown bank note shows for example background pattern 13 of fine lines (guilloches) produced by offset and serial number 14 applied by letterpress. Further, there is printed image 15 representing the number five. Printed image 15 is realized by conventional intaglio.

The inventive print, which can be produced for example with a printing plate according to FIG. 1, is provided only in a partial area of the bank note in the example shown here and consists of printed area 16, which indicates a portrait. The different halftones of the picture motif are rendered by variation of line distance and/or line width. Each line appearing in the portrait corresponds to an inventively printed structural element. Edge areas and inside area of each structural element are seamlessly adjacent and were printed by intaglio with ink layers of different thickness, the edge area having a thicker ink layer than the inside area. The ink-saving effect in the inventive print is distinctly noticeable in particular when a great number of line structures are used in the area to be printed, i.e. at very high density of the line structures in the printed image. An area with high line density is for example hair area 17 in the portrait. Assuming further that hair area 17 usually occupies about half the portrait surface in a portrait depending on the motif, and the portrait in turn about one half to one third of the surface of the bank note, a considerable reduction of ink consumption and thus production costs results at a productive capacity of several billion bank notes.

Figure 4:
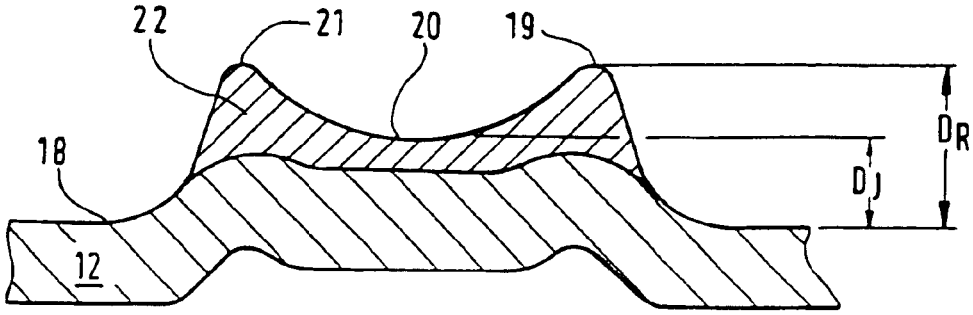
FIG. 4 shows a detail of a printed data carrier in cross section.

FIG. 4 shows in cross section a detail of a data carrier area printed according to the invention as results for example using the printing plate shown in FIG. 1 with d=0 microns for printing individual hairs, as indicated in the portrait of FIG. 3. In the printing operation, data carrier 12 is pressed onto the printing plate whereby data carrier 12 is embossed by the surface of the plate structured due to engraving 3 and at the same time ink 22 from engraved area 3 is received onto data carrier upper side 18. The level difference between the unprinted substrate surface and the surfaces of particular ink surface area 19, 20, 21 is defined as the ink layer thickness of edge area $D_R$ and of inside area $D_i$. The printed area is characterized by an ink layer that is thicker at the edge areas than in the inside area and leaves a tactilely perceptible print. In the present case, the ink layer thicknesses of edge areas 19 and 21 are the same and the profiles wedge-shaped. However, it is likewise possible in a further embodiment that edge areas 19 and 21 have different ink layer thicknesses and/or different profiles. Depending on the ink layer thickness, the ink show transparent or opaque properties so that the edge areas and inside areas face the viewer as homogeneous surfaces in the case of very great ink layer thicknesses or visually distinguishable areas at lower ink layer thickness.

The advantage of the inventive embodiments is that the reduced ink layer thickness of the inside areas compared to the edge areas leads to a distinct saving of ink. Simultaneously, the tactility of the printed image is retained or increased, however, since the edge areas strengthen the relief of the printed image due to the greater ink layer thickness in comparison with the inside area. The ink-saving effect is noticeable in particular in the embodiment using opaque inks. As of a certain ink layer thickness, the visual impression of the color tone no longer changes, i.e. thicker inking does not make the printed image darker but the latter has reached a saturation value. To produce a homogeneous color effect it thus suffices to print the inside area just thick enough to produce the darkest possible color tone. The ink thereby saved considerably reduces the production costs.

What is claimed is:

1. An intaglio printing plate for producing a printed image comprising at least one engraved area in the plate surface, wherein the engraved area has one or more structural elements in which an edge area has a greater engraving depth than an inside area, the edge area and the inside area directly abut, and the inside area is generally configured as a plateau that is lowered relative to the plate surface.

2. The printing plate according to claim 1, wherein the edge area is configured to be wedge-shaped or trapezoidal.

3. The printing plate according to claim 1, wherein the edge area is configured as a wedge with a round tip.

4. The printing plate according to claim 1, wherein the surface of the inside area is provided with a basic roughness pattern to provide an ink trap.

5. The printing plate according to claim 1, wherein the edge area has an engraving depth of 60 microns to 150 microns.

6. The printing plate according to claim 1, wherein the inside area has an engraving depth of 10 microns to 120 microns.

7. The printing plate according to claim 1, wherein the edge area and the inside area each have an engraving depth at which all printed areas in the printed image have the same color tone when viewed with the naked eye.

8. The printing plate according to claim 1, wherein the edge area has an engraving width b of 120 microns to 500 microns and an engraving width of the base surface d of 0 to 500 microns.

9. The printing plate according to claim 1, wherein the structural element is configured in the form of a character and/or pictorial symbol.

10. The printing plate according to claim 1, wherein the structural element is designed in the form of a line.

11. The printing plate according to claim 10, wherein the line has a width a of 0.1 millimeters to 5 millimeters.

12. The printing plate according to claim 11, wherein the line has a width a of 0.5–3 mm.

13. An intaglio printing process for printing a printed image comprising using a printing plate according to claim 1.

14. A data carrier with a printed image produced by intaglio comprising at least one printed image area having an ink layer, wherein the printed image area has one or more printed structural elements in which the ink layer thickness is greater in an edge area than in an inside area directly abutting the edge area, and the ink layer in the inside area is generally configured as a plateau that is lowered relative to the ink layer of the edge area.

15. The data carrier according to claim 14, wherein the ink layer thickness difference between edge area and inside area is tactilely perceptible.

16. The data carrier according to claim 14, wherein the edge area is configured to be wedge-shaped or trapezoidal.

17. The data carrier according to claim 14, wherein the edge area and the inside area have the same color tone.

18. The data carrier according to claim 14, wherein the edge area has a darker color tone than the inside area.

19. The data carrier according to claim 14, wherein the printed structural element is designed in the form of a character and/or pictorial symbol.

20. The data carrier according to claim 14, wherein the structural element is configured in the form of a line.

21. The data carrier according to claim 20, wherein the line has a width of 0.1 to 5 millimeters.

22. The data carrier according to claim 21, wherein the line has a width of 0.5–3 mm.

23. A method for producing an intaglio printing plate for printing a surface by intaglio comprising the following steps:

providing a printing plate with a printing plate surface, and engraving at least one engraved area in the printing plate surface by means of an engraving tool so that the engraved area has one or more structural elements in which an edge area has a greater engraving depth than an inside area, the edge area and the inside area directly abut, and the inside area is generally configured as a plateau that is lowered relative to the printing plate surface.

* * * * *